US008602105B2

(12) United States Patent
Sinclair

(10) Patent No.: US 8,602,105 B2
(45) Date of Patent: Dec. 10, 2013

(54) ACTUATOR DEVICE FOR DOWNHOLE TOOLS

(76) Inventor: Ewan Sinclair, Aberdeen (GB)

( * ) Notice: Subject to any disclaimer, the term of this patent is extended or adjusted under 35 U.S.C. 154(b) by 482 days.

(21) Appl. No.: 12/866,685

(22) PCT Filed: Jan. 29, 2009

(86) PCT No.: PCT/GB2009/050082

§ 371 (c)(1),
(2), (4) Date: Oct. 29, 2010

(87) PCT Pub. No.: WO2009/098498

PCT Pub. Date: Aug. 13, 2009

(65) Prior Publication Data

US 2011/0036585 A1 Feb. 17, 2011

(30) Foreign Application Priority Data

Feb. 7, 2008 (GB) ..... 0802180.0
Sep. 9, 2008 (GB) ..... 0816472.5

(51) Int. Cl.
*E21B 34/14* (2006.01)

(52) U.S. Cl.
USPC ..... 166/317

(58) Field of Classification Search
USPC ..... 166/317, 376, 319, 332.1
See application file for complete search history.

(56) References Cited

U.S. PATENT DOCUMENTS

| | | | |
|---|---|---|---|
| 5,950,733 | A | 9/1999 | Patel |
| 6,182,753 | B1 | 2/2001 | Schultz |
| 6,223,824 | B1 | 5/2001 | Moyes |
| 6,230,808 | B1 | 5/2001 | French et al. |
| 6,340,062 | B1 | 1/2002 | Skinner |
| 7,168,493 | B2 | 1/2007 | Eddison |
| 2007/0193377 | A1 | 8/2007 | Irani et al. |

*Primary Examiner* — Giovanna Wright
(74) *Attorney, Agent, or Firm* — Dickinson Wright PLLC

(57) ABSTRACT

An actuator device for downhole tools comprising: indexing means for progressively moving a rupturing member (12, 16); a pressure activated actuating member in fluid communication with a chamber; and a frangible member (HA) interposing the indexing means and the chamber, wherein the actuator device is adapted such that, upon a predetermined movement of the rupturing member, the rupturing member ruptures the frangible member to allow high pressure fluid to enter the chamber and activate the actuating member.

10 Claims, 6 Drawing Sheets

ACTUATOR DEVICE FOR DOWNHOLE TOOLS

CROSS REFERENCE TO RELATED APPLICATIONS

The present application is a 35 U.S.C. §371 national phase filing of International Patent Application No. PCT/GB/2009/050082, filed Jan. 29, 2009, and through which priority is claimed to Great Britain Applications Serial No. 0802180.0 and Serial No. 0816472.5, filed Feb. 7, 2008, and Sep. 9, 2009, respectively, the disclosures of which applications are incorporated herein by reference in their entireties.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

FIELD OF THE INVENTION

This invention relates to a counter mechanism and actuator device for down-hole tools, in particular but not exclusively comprising a counter and trigger, integrated with an actuator for operating down-hole tools, such as ball valves. The counter may be operated by hydraulic pressure cycles.

BACKGROUND OF THE INVENTION

In the oil and gas industry, as with other industries, it is desirable to reduce the time taken to carry out specific operations. This can be achieved in some instances by improvements in technology, which reduce the time taken to carry out these operations. One particular instance is to actuate down-hole tools remotely by applying pressure to the well bore or well tubing string, as used with hydraulic set packers, which are known in the industry. The limitation of this method is that it may be advantageous to carry out pressure testing, prior to actuating the down-hole tool, especially if the required pressure is the same as that required to actuate the down-hole tool.

Various down-hole tools use pressure actuated counter mechanism and actuators, such as those described in US patents, Downhole Apparatus U.S. Pat. No. 6,223,824 and Downhole apparatus U.S. Pat. No. 6,230,808. Other counters are described in U.S. patents, Formation Isolation Valve U.S. Pat. No. 5,950,733 and Downhole tool U.S. Pat. No. 7,168,493.

In the example of the ball valve, it is sometimes desirable to close the valve when withdrawing tools from the well following an operation such as gravel packing. Closing the valve with a shifting tool, such as the Otis B shifting tool, does this. This type of tool is known in the industry.

BRIEF SUMMARY OF THE INVENTION

According to a first aspect of the present invention there is provided an actuator device for downhole tools comprising:

indexing means for progressively moving a rupturing member;

a pressure activated actuating member in fluid communication with a chamber; and a frangible member interposing the indexing means and the chamber, wherein the actuator device is adapted such that, upon a predetermined movement of the rupturing member, the rupturing member ruptures the frangible member to allow high pressure fluid to enter the chamber and activate the actuating member.

The actuator device may be used to open ball valves.

In a particular embodiment, the invention links a hydro-mechanical counter to an actuator via a trigger mechanism.

The indexing means may comprise a counter which comprises a piston and spring return. the piston and spring return may increment a rod, which drives the rupturing member, such as a pin, through the frangible member, such as a metal plate. The rupturing member may be adapted to rupture the frangible member after a predetermined number of pressure cycles, allowing hydrostatic pressure to move the actuating member.

The frangible member is preferably a rupture disc, or burst disc, with a burst pressure higher than that experienced by the down-hole tool during normal operations.

Preferably, the actuator device includes two or more sealed chambers, where the pressure in each chamber is at atmospheric pressure, or a lower pressure than that experienced by the tool in normal operations. The two chambers balance one another in that there is no net force on the actuating member in the unset position.

Preferably, the actuator moves to carry out its function in the down-hole tool when one of the sealed chambers is flooded by fluid, either gas or liquid, at well pressure.

In a particular embodiment, the pin and frangible disc form the trigger for the actuating member.

Preferably the indexing means may be temporarily fixed in such a manner as to prevent the counter operating, while at surface, to allow the tool to be pressure tested.

BRIEF DESCRIPTION OF THE SEVERAL VIEWS OF THE DRAWINGS

A particular embodiment of the invention as utilised in a down-hole ball valve will now be described by way of example only with reference to the accompanying drawings in which.

DETAILED DESCRIPTION OF THE INVENTION

Figure 1:
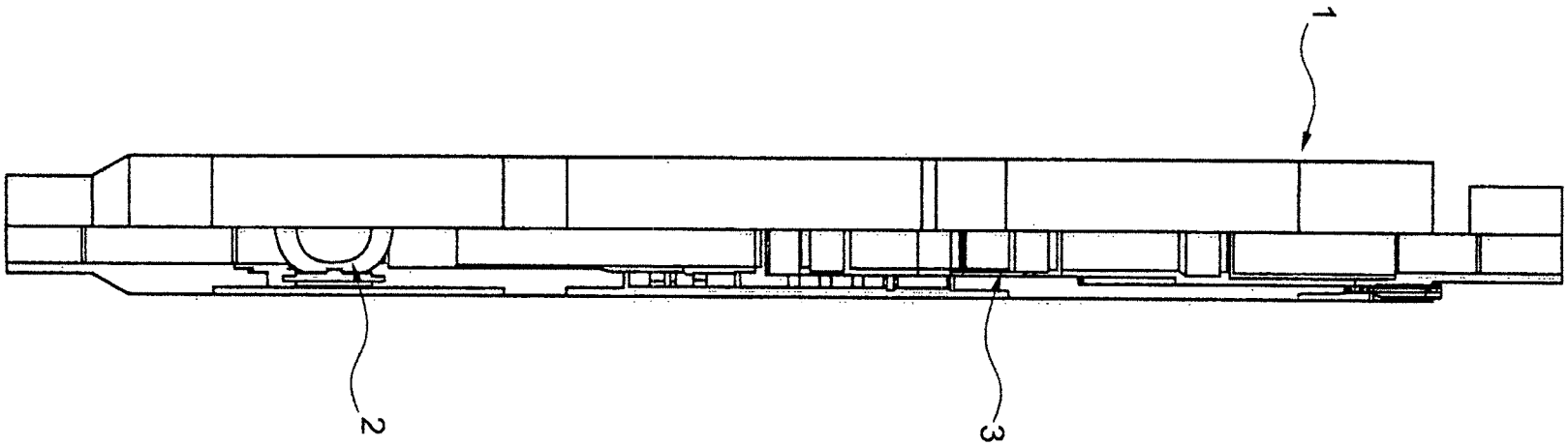
FIG. 1 shows an entire ball valve, with the ball in the closed position.

In a particular embodiment of the invention, a ball valve 1 is part of a well tubing string. It has the ball in the closed position in FIG. 1. The ball is held in the closed position, via internal linkages by a sleeve 3. The sleeve abuts the actuating member or actuator 4. The ball valve may be opened or closed by manipulation of the sleeve 3 to open (FIG. 1) and closed (FIG. 2) positions. This is achieved using a shifting tool.

Figure 3:
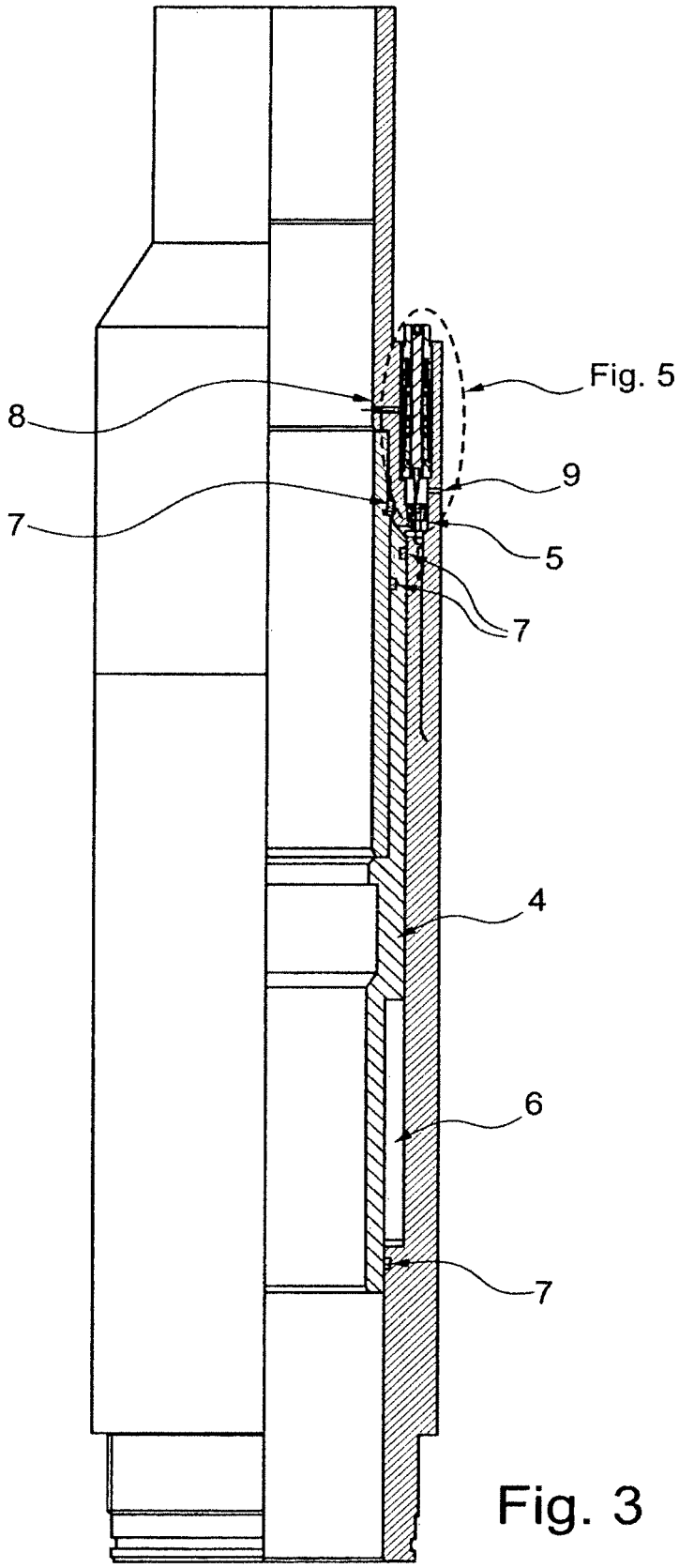
FIG. 3 shows a detailed view of the upper section of the ball valve, containing the counter and actuator. The actuator position is shown as in FIG. 1.
Figure 4:
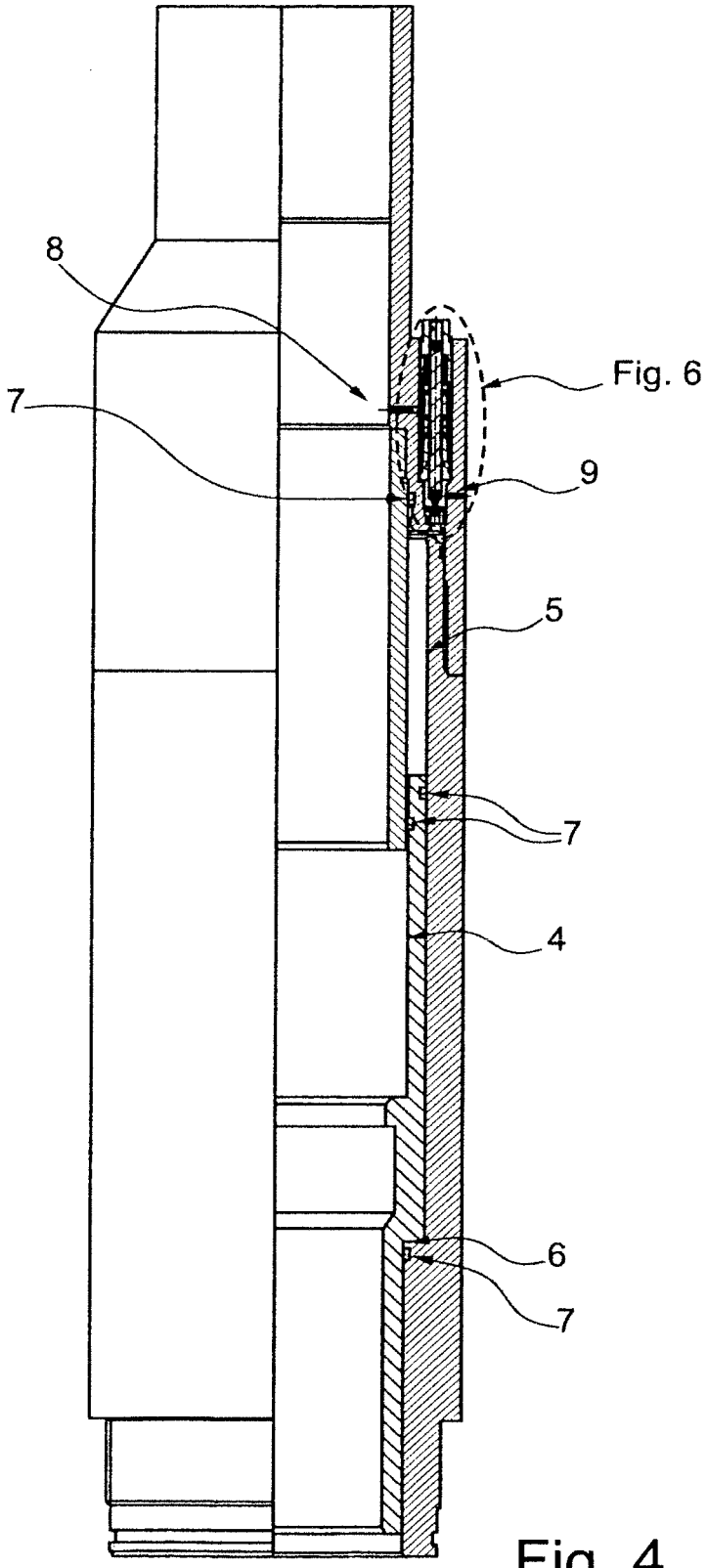
FIG. 4 shows a detailed view of the upper section of the ball valve, containing the counter and actuator. The actuator position is shown as in FIG. 2.
Figure 5:
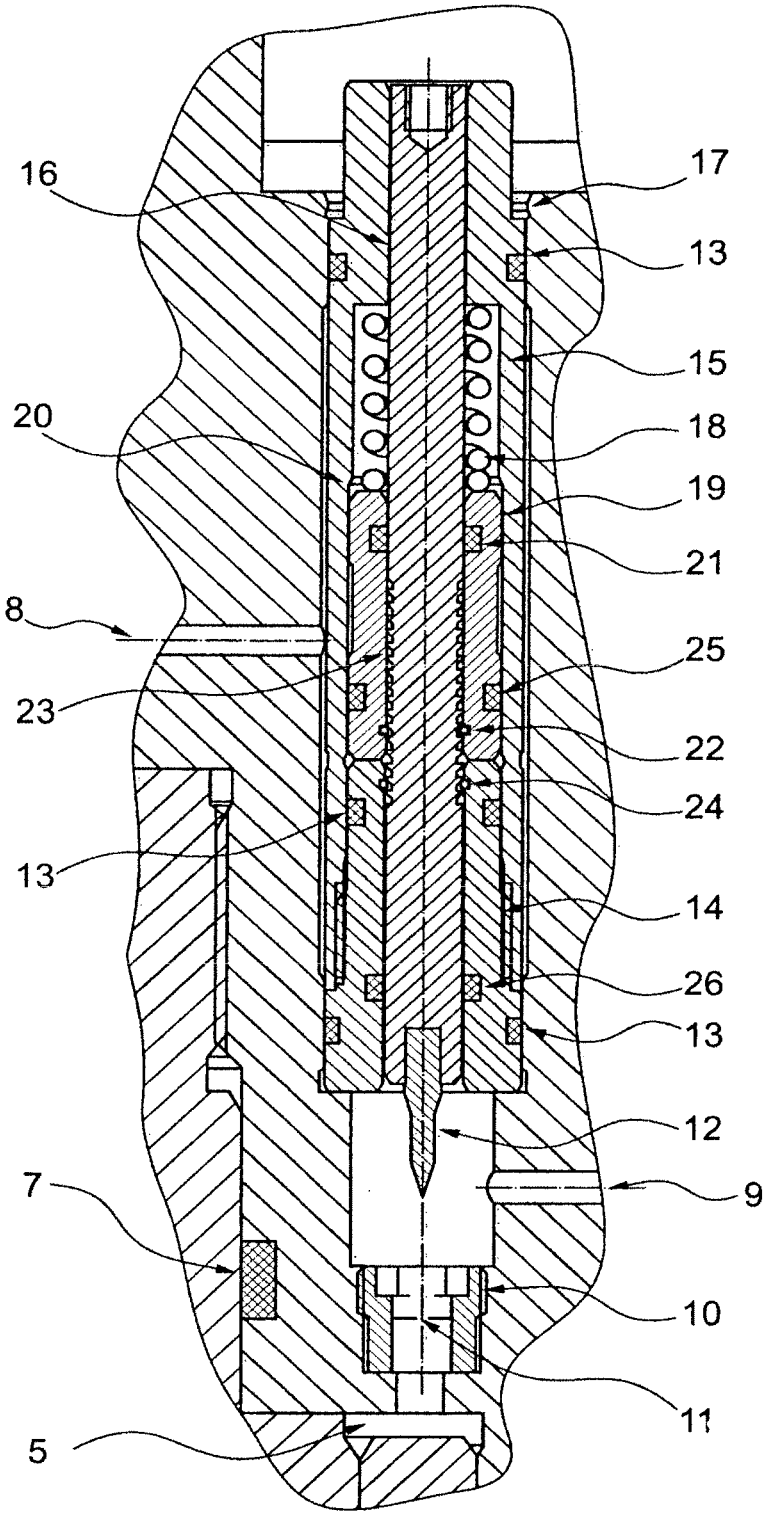
FIG. 5 shows the detail of the counter and trigger mechanism, in the position shown in FIGS. 1 and 3.

As shown in FIG. 3, atmospheric chambers 5 and 6 are maintained by seals 7 and rupture disc assembly 10 around the actuator 4. The seals are so arranged so that there is no net load on the actuator, i.e. the actuator is maintained in the position of FIG. 3.

Before tubing pressure cycles are applied well pressure enters the indexing means or counter mechanism via ports 8 and 9. When tubing pressure is applied, a pressure differential exists within the counter. This differential pressure acts on piston 19, where seals 21 and 25 are arranged to give a piston effect due to pressure differential applied through port 8. The piston moves, further compressing spring 18, until it contacts surface 20. As the piston moves, a c-ring 22 rides up an angled face 23 on rod 16, snapping back into the next groove on the rod 16 at the end of the permitted travel. The rod 16 is prevented from moving in the same direction by a second c-ring 24.

When applied pressure is removed, the spring 18 returns the piston 19 to its initial position, moving the rod via the c-ring 22. As the rod moves down, the second c-ring 24 rides up an angled face 23 on rod 16, snapping back into the next groove on the rod 16 at the end of the permitted travel. Thus pressure cycles move the rod 16 and rupturing member or pin 12 towards the frangible member or plate 11 in the rupture disc assembly 10.

The rod and piston arrangement is preferable housed within a sleeve 15 and cap 14. Seals 13 and 26 are arranged to provide pressure integrity. The assembly is held within the tool by a circlip 17. Due to the arrangement of the seals, there is no piston effect on the counter assembly, allowing use of the said circlip.

Figure 2:
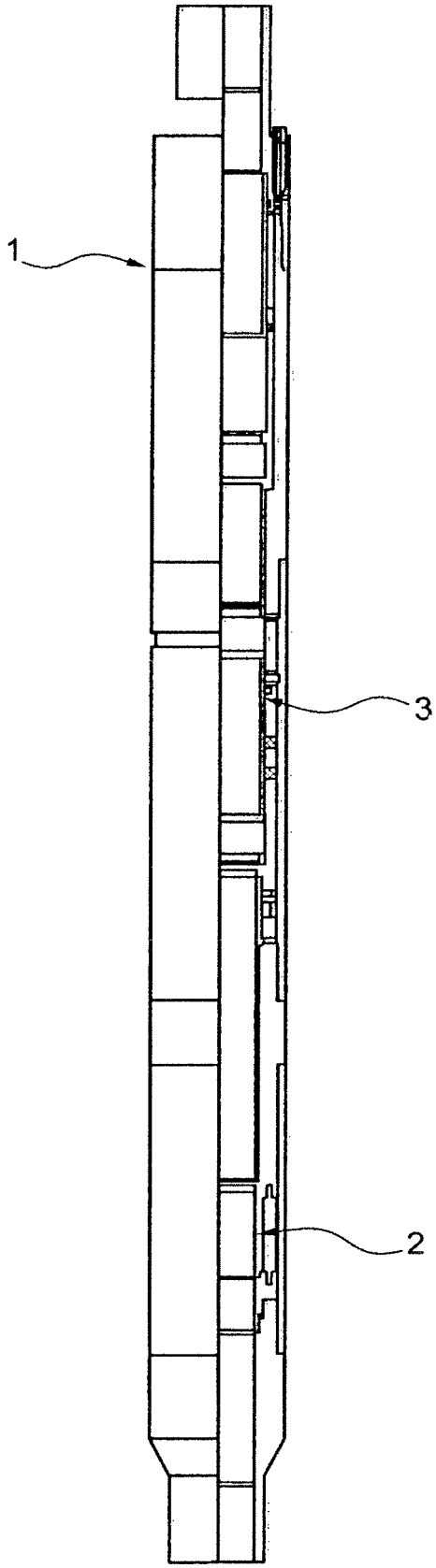
FIG. 2 shows the ball valve in the open position, having been cycled open.
Figure 6:
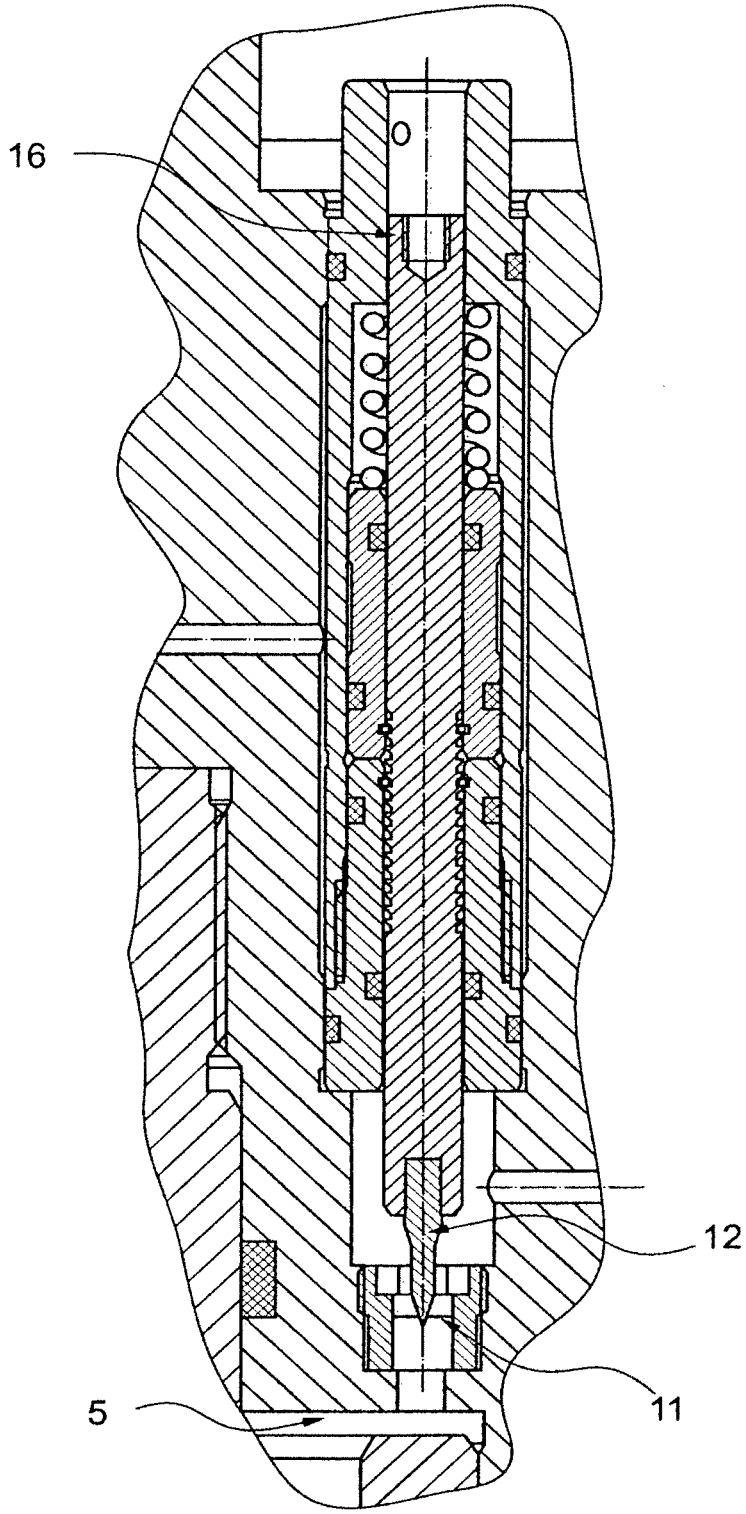
FIG. 6 shows the detail of the counter and trigger mechanism, in the position shown in FIGS. 2 and 4.

As can be seen in FIG. 6, after a pre-determined number of pressure cycles, the rod 16 and pin 12 have moved sufficiently to pierce the frangible plate 11. This allows well pressure to flood chamber 5, which imparts a load to the actuator 4, collapsing chamber 6 and moving sleeve 3, which via the internal linkages, opens the ball 2 (as shown in FIG. 2).

Use of the invention is not limited to opening ball valves. Any type of down-hole tool, where it is possible to apply tubing or annulus pressure cycles, can utilise this design to carry out a function within the tool. Examples include, but not limited to wire-line conveyed locks and plugs. Plugs may be opened remotely by applying tubing pressure cycles.

In can be seen to those skilled in the art that various changes may be made to the features within this embodiment, without departing from the scope of the invention.

SEQUENCE LISTING

Not Applicable.

The invention claimed is:

1. An actuator device for downhole tools comprising:

indexing means for progressively moving a rupturing member; a pressure activated actuating member in fluid communication with a chamber; and a frangible member interposing the indexing means and the chamber, wherein the actuator device is adapted such that, upon a predetermined movement of the rupturing member, the rupturing member ruptures the frangible member to allow high pressure fluid to enter the chamber and activate the actuating member; and wherein the indexing means comprises a counter comprising a piston and return spring, wherein the piston is biased towards the frangible member due to the biasing force of the return spring, wherein each time a pressure is exerted on the piston that exceeds the biasing force of the return spring, the piston is moveable away from the frangible element against the biasing force of the spring, and on release of said pressure, the piston returns towards to the frangible element under spring force, wherein upon each piston return the rupturing member is incrementally moveable towards the frangible element.

2. An actuator device as claimed in claim 1, wherein the actuator device is used to open ball valves.

3. An actuator device as claimed in claim 1, wherein the counter is a hydro-mechanical counter which is coupled to the actuating member via a trigger mechanism.

4. An actuator device as claimed in claim 1, wherein the piston and spring return are adapted to increment a rod which drives the rupturing member through the frangible member.

5. An actuator device as claimed in claim 1, wherein the rupturing member is adapted to rupture the frangible member after a predetermined number of pressure cycles allowing hydrostatic pressure to move the actuating member.

6. An actuator device as claimed in claim 1, wherein the frangible member comprises a rupture disc having a burst pressure higher than that experienced by the downhole tool during normal operations.

7. An actuator device as claimed in claim 1, wherein the actuator device includes at least two sealed chambers, and wherein the pressure in each chamber is at one of atmospheric pressure and a lower pressure than that experienced by the downhole tool in normal operations.

8. An actuator device as claimed in claim 7, wherein the two chambers are substantially balanced such that there is substantially no net force on the actuating member in the unset position.

9. An actuator device as claimed in claim 7, wherein the actuator is adapted to move when one of the sealed chambers is flooded by a fluid at well pressure.

10. An actuator device as claimed in claim 1, wherein the indexing means is temporarily fixable to prevent the counter operating, while at surface, to allow the tool to be pressure tested.

* * * * *